US005941119A

United States Patent [19]

Monteiro

[11] Patent Number: 5,941,119

[45] Date of Patent: Aug. 24, 1999

[54] MECHANICAL DEVICE APPLIED IN A TRANSFER SYSTEM

[75] Inventor: Luciano T. S. Monteiro, Sao Paulo, Brazil

[73] Assignee: Prodty Industria E Comercio Ltda., Sao Caetano do sul Sao Paulo, Brazil

[21] Appl. No.: 08/995,413

[22] Filed: Dec. 19, 1997

[30] Foreign Application Priority Data

Dec. 20, 1996 [BR] Brazil ..... 9606122

[51] Int. Cl.[6] ..... B21D 43/05

[52] U.S. Cl. ..... 72/405.16; 72/405.13; 198/621.1

[58] Field of Search ..... 72/405.16, 405.13, 72/405.11, 405.09, 405.01; 198/621.3, 621.4; 100/207

[56] References Cited

U.S. PATENT DOCUMENTS

| | | | |
|---|---|---|---|
| Re. 34,581 | 4/1994 | Sofy | 72/405.16 |
| 4,513,602 | 4/1985 | Sofy | 72/405.13 |
| 4,875,931 | 10/1989 | Monteiro | 72/421 |
| 5,307,666 | 5/1994 | Bianchi | 72/405.11 |

FOREIGN PATENT DOCUMENTS

| | | | |
|---|---|---|---|
| 64129 | 4/1984 | Japan | 72/405.09 |

*Primary Examiner*—Daniel C. Crane
*Attorney, Agent, or Firm*—Pillsbury Madison & Sutro LLP

[57] ABSTRACT

Apparatus for use in a transfer system for causing movement in first and second orthogonal directions includes a ball screw for moving a carriage in the first direction a predetermined distance and then moving a primary lever and concurrently a second lever to cause movement of the carriage in the second direction.

5 Claims, 7 Drawing Sheets

MECHANICAL DEVICE APPLIED IN A TRANSFER SYSTEM

This application claims priority benefit from application No. 9606122-7 filed Dec. 20, 1996 in Brazil, the content of which application is hereby incorporated hereinto by reference.

BACKGROUND OF THE INVENTION

The present invention of a mechanical device applied in a transfer system is an improvement of the device in corresponding patents issued in Brazil as No. 8701734 and in the U.S. as U.S. Pat. No. 4,875,931, by the same inventor/applicant, and it provides a mechanical arrangement used mainly for automating the several processing stations of, for example, a metal stamping processed metal part in a conventional press.

SUMMARY OF THE INVENTION

The main characteristic of this mechanism is its simplicity mainly when compared with other transfer mechanisms used to perform the same operation. The present mechanism, which is the object of this application, has a very simple mechanism to the closing fingers axis when it reaches a defined displacement point, where it converts the additional travel and control for the lifting fingers or orthogonal movement (usually vertical), resulting therefore in another controlled axis, providing an operational sequence with a relevant cost reduction in the transfer system.

Basically, the present invention uses a driven screw to move the mechanism in a first direction a desired amount to a stopping point while the driven screw continues to rotate and through a lever system causes a part of the mechanism to move in a second direction which is orthogonal to that first direction.

The traditional and known transfer mechanisms use one drive system with respective controls for each axis. This means for the mostly used and traditional transfer mechanisms the three axis systems have three independent drives and controls, and this represents relevant costs. The solution of using one drive system for two displacements movements was the object of the patents described above. In that case it was based in a mechanical driven transfer mechanism. In this present application the basic concept was developed for a servo motor driven and C. N. C. controlled transfer mechanism; however, both mechanisms can be used with any of these drive types. Due mainly to the transfer system prices, most of the existing transfers systems use only two axis motions, one for the closing of the transfers fingers, and another for the pitch or the forward move of the parts between the die stations. After leaving the part in sequence or at the next station, the transfer mechanism opens the fingers and goes backwards to the initial or start point, mainly with one pair of fingers for each die station.

The operational cycle usually has several steps that complete the operation in a three axis transfer system, represented by an elevated number of mechanical, drive and control systems for each axis of movement. Basically these are the three different steps: a) The fingers move forward to the next die station representing the closing motion, b) the fingers with the parts already picked up lift the parts, representing the lifting motion, and c) the fingers once in the upper position transfers the parts to the next die station. This is the transference movement. The transfer continues its cycle by returning in a different sequence; first lowering the vertical movement the transfer deposits the parts in the next die station, in sequence it opens the fingers and afterwards returns the fingers back to the restart point. The fingers that are usually one pair for each die station are assembled in one pair of rails. Therefore, all the parts are transferred simultaneously between all the die stations.

The great advantage of the mechanism covered by the present application is the fact that it eliminates one driven and control mechanism system, adding only basically a pivoted lever and without losing any advantage or control of a comparable and traditional known transfer system. Even the cycle time can be slightly improved due to the easy control. Due to this simplicity it became possible to assemble this mechanism in a sub-plate, then four of these sub-plates are assembled two in one side connected with bars and two in the other side also connected with bars representing the basic mechanism for a three axis transfer system.

BRIEF DESCRIPTION OF THE DRAWINGS

In order to illustrate and understand the present mechanical device itself and as applied in a transfer system, the following figures are presented. It is emphasized that these figures are illustrative and should not be understood as limiting the scope of the invention.

DETAILED DESCRIPTION OF THE INVENTION

Figure 1:
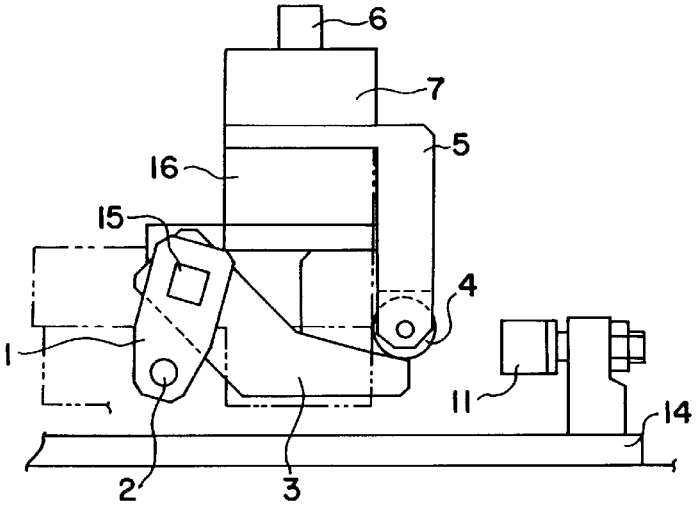
FIG. 1 is a side view of the lifting mechanism system or third axis when the fingers would be in the retreated and lowered position.
Figure 2:
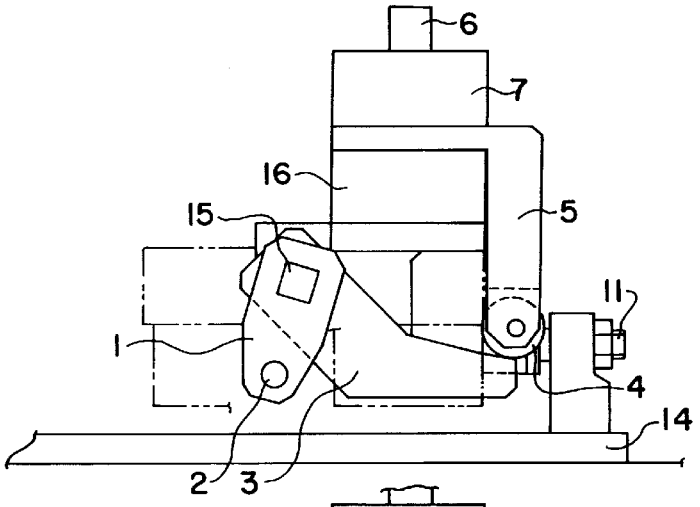
FIG. 2 is the same side view as FIG. 1 when the fingers would be in the forward (or closed) and lowered position, and it shows the device at the end or limit (adjustable) of the first horizontal travel at forward or closed position.
Figure 3:
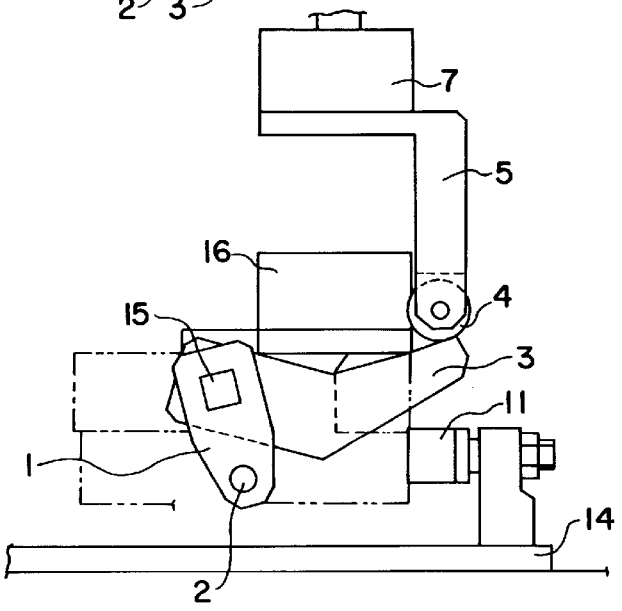
FIG. 3 is the same side view as in FIGS. 1 and 2 when the fingers would be in the forward or closed and upper position, and it shows that a portion of the device has lifted with the rotation (counter-clockwise) of pivoted levers 1 and 3.

The mechanical device applied in a transfer system is basically a mechanical arrangement which is part of a transfer set which has the function to grasp, lift and transport or transfer the parts in a metal stamping process, or any other similar process. To handle the parts, it uses additionally some known grippers. These grippers are usually used in pairs, but can be only one, for each process station and are assembled orthogonal, in one or two opposite rails. These rails move forward, upwards and parallel to the process flow direction. The present mechanical arrangement uses only one drive system for a two axis motion, or more specifically, uses the drive system to close the grippers and additionally to lift the bars/grippers and parts.

The mechanical arrangement includes of a lower pin 2, which is attached by a lever 2' to the case 12 of the ball screw 8, a primary lever 1 pivoted on pin 2 and connected by square pin 15 to a secondary lever 3, which at its opposite end is always in contact with a freely turning roller drive 4 that is installed in the connecting bar 5. Bar 5 in turn is connected with the rising structure support rail 7, which holds the pitch linear guide 6.

This entire set is connected by a longitudinal bar to another similar and parallel assembled set, and usually has a similar arrangement at the opposite side of the process center line. It is driven by a ball screw 8, which has attached a pulley 9. This pulley in this present embodiment is driven by a toothed belt, or any other appropriate similar and known drive component, such as a chain, one being driven on both sides, with a connecting crossing bar driving the two axes (rails closing and lifting) for the entire transfer set as shown. Another option is to use one motor to drive each side, with no connecting bar between the two sides of the transfer sets.

Figure 4:
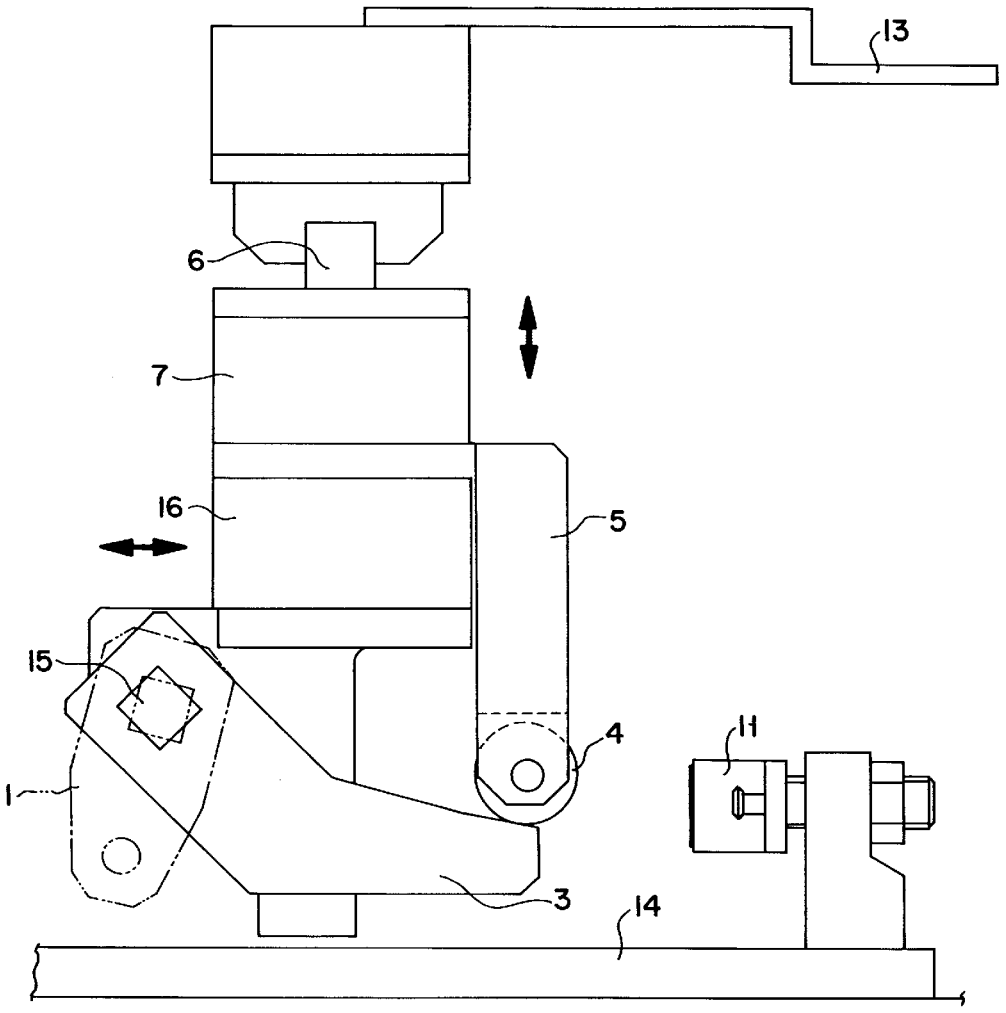
FIG. 4 is the same side view as FIGS. 1, 2, and 3, in a larger scale view.
Figure 5:
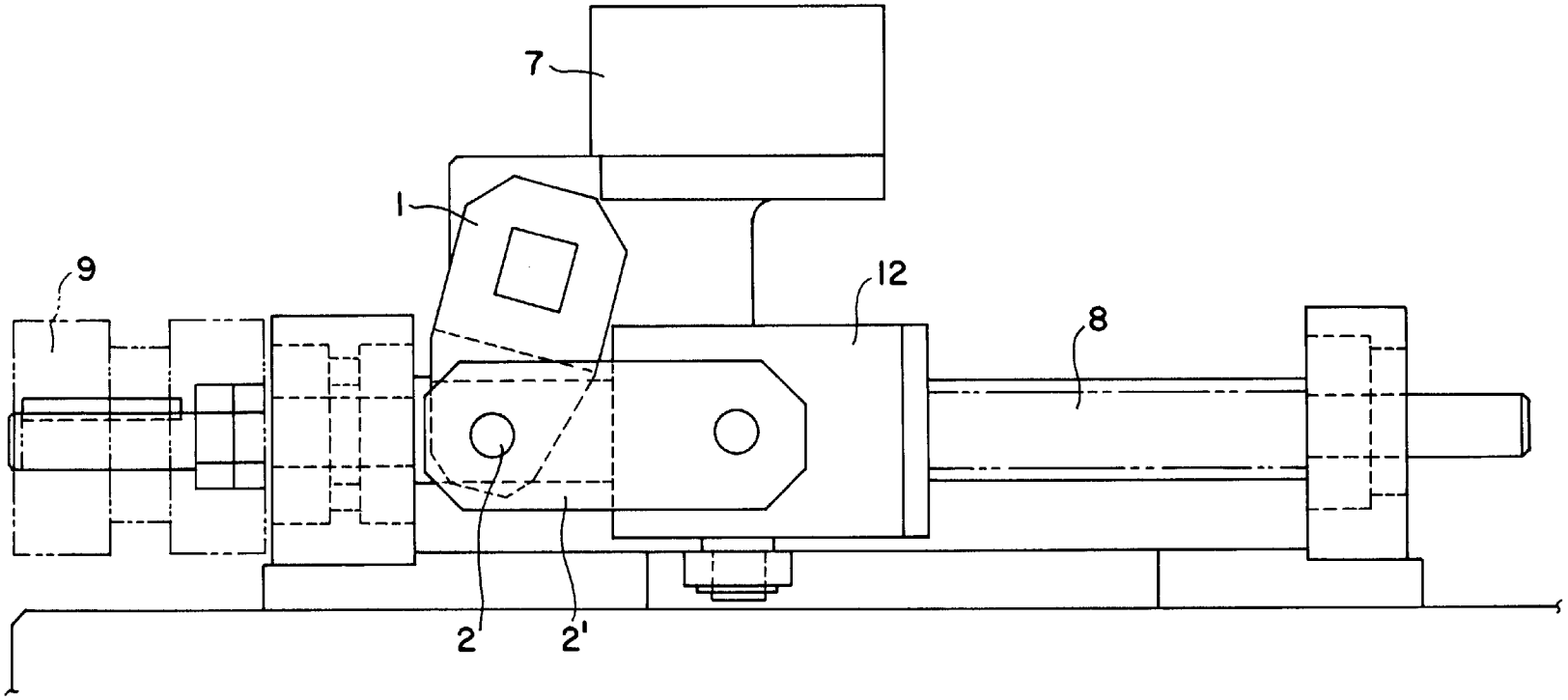
FIG. 5 is another vertical view, with the addition of a drive pulley and ball screw.
Figure 6:
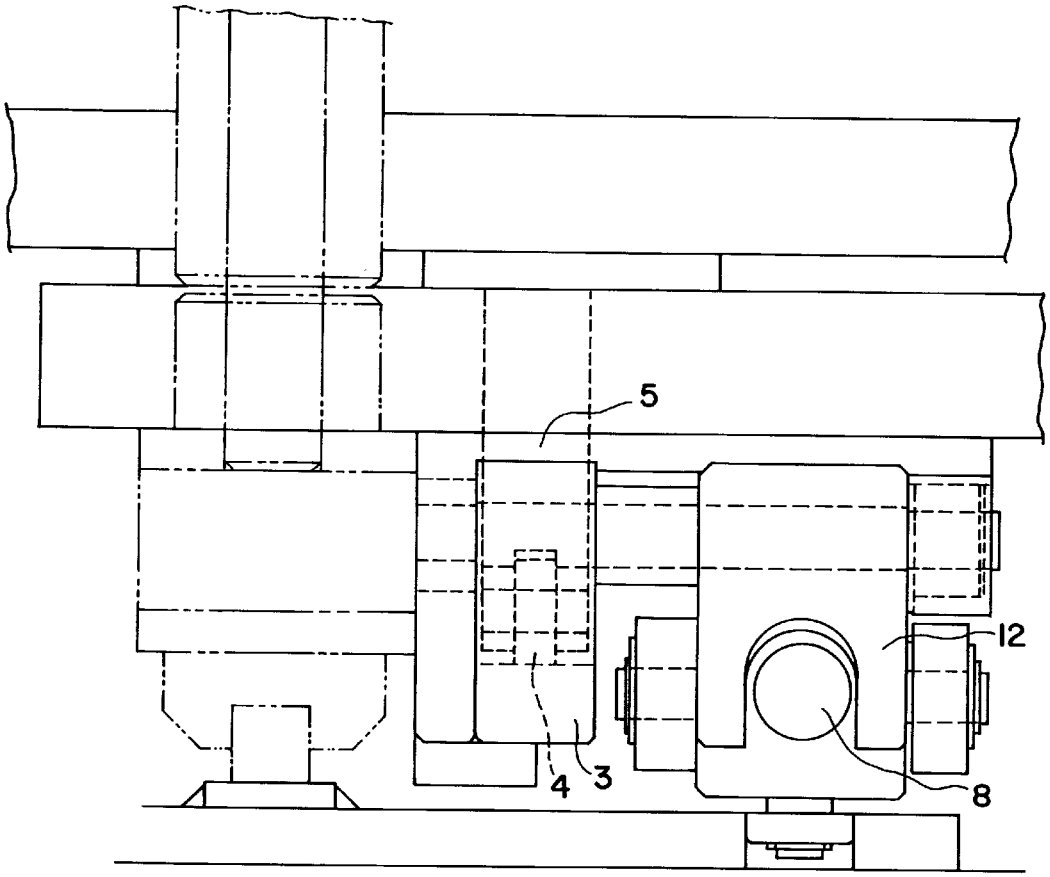
FIG. 6 is a view from the back; showing the closing and lifting mechanism and the ball screw and horizontal and vertical guides.
Figure 7:
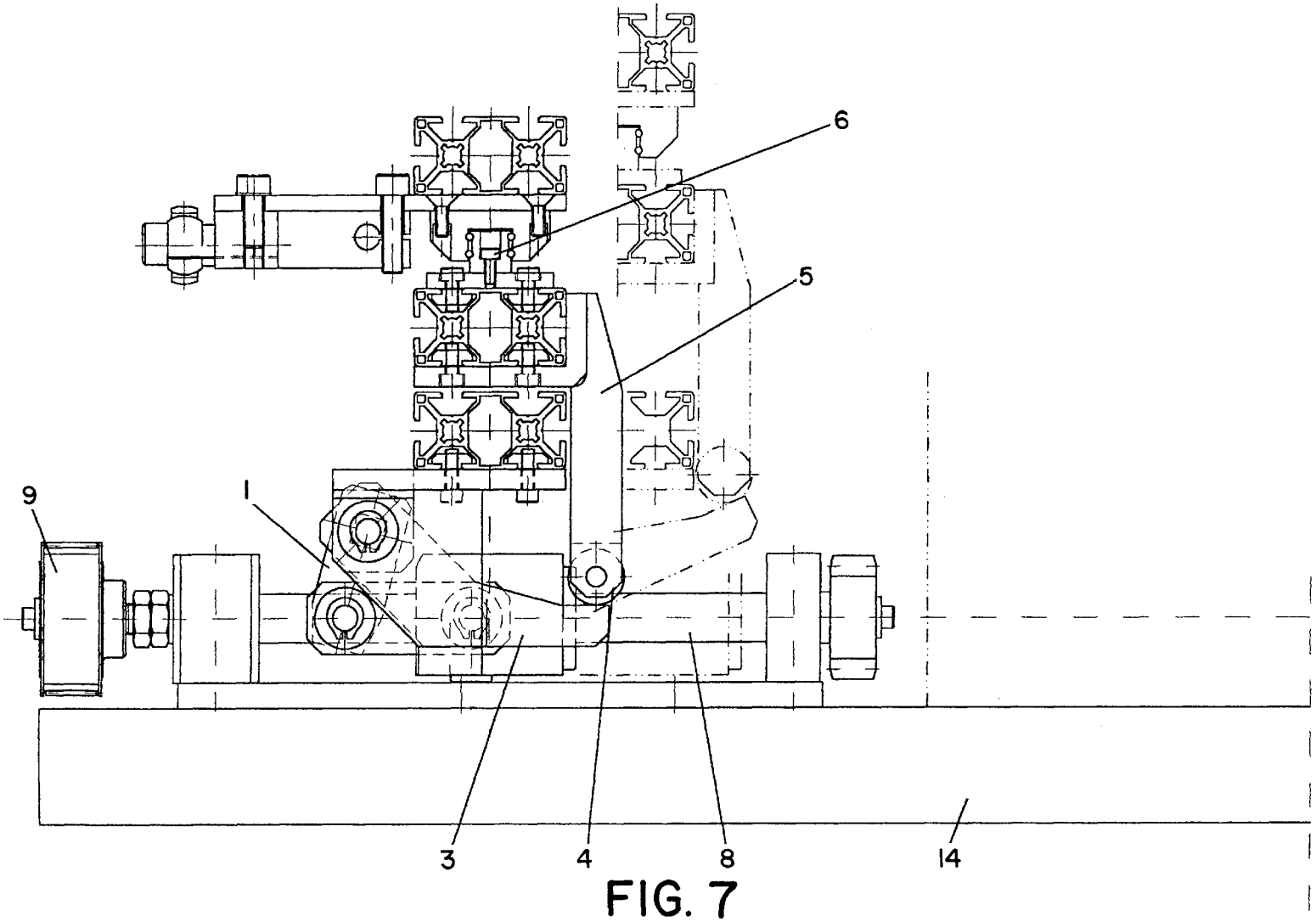
FIG. 7 shows the complete and detailed set of the side view of the fingers closing and lifting mechanism.
Figure 8:
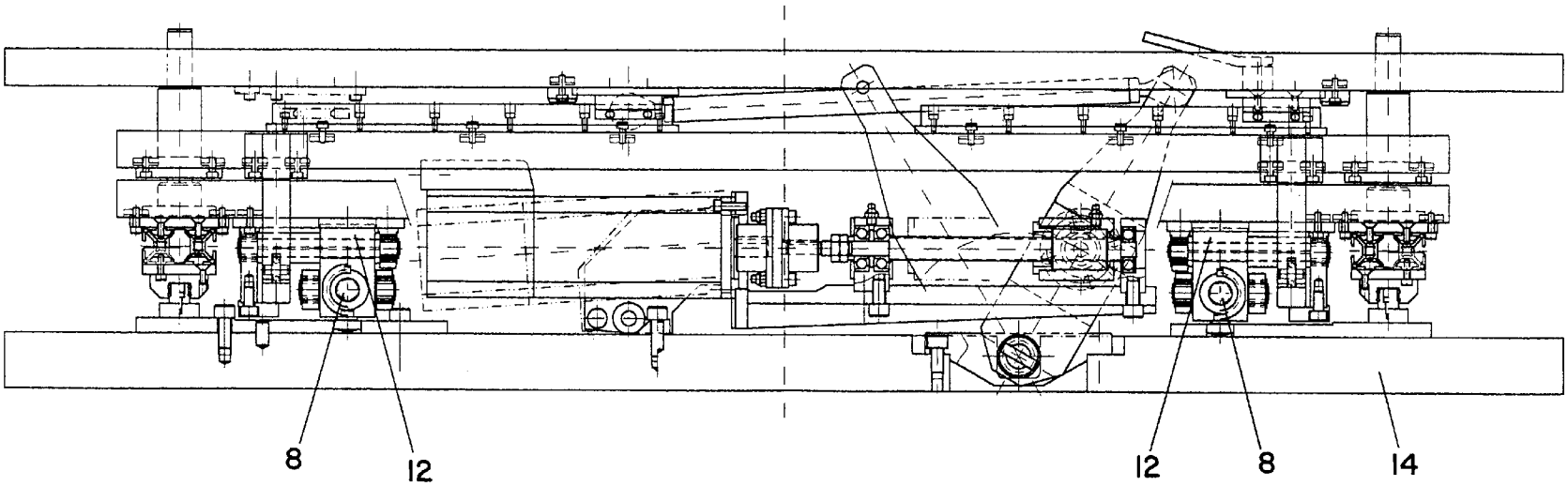
FIG. 8 shows a lateral view of the complete transfer die set.
Figure 9:
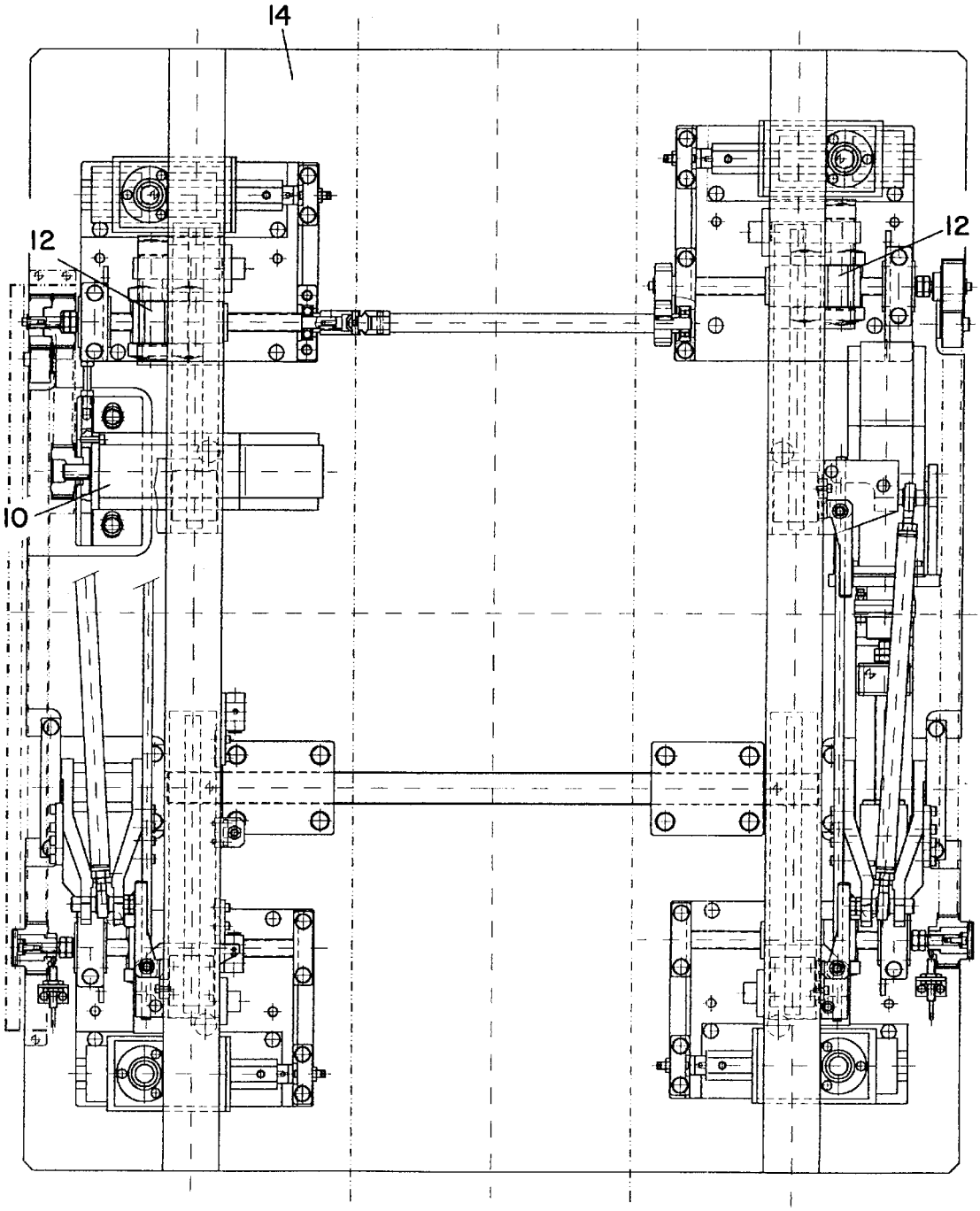
FIG. 9 is a top (plan) view of the complete transfer die set showing the two closing and lifting mechanisms linked with the aluminum extrusion bars, in each side of the transfer die set and also the motor and mechanism for the forward and backwards transfer pitch travel.

In operation of this transfer set, the mechanism (which includes as movable means the carriage 16) moves forward and backwards in the longitudinal direction of ball screw 8. Moving forward a predetermined distance, it reaches the stop forward limit 11, which is adjustable for any desired position. As the ball screw continues to turn and the mechanism including the bar 16 cannot go forward anymore, the ball screw case 12 (FIG. 5), attached to the ball screw, continues to move forward, and the pull by lever 2' starts rotating the lever means including primary lever 1 and lever 3. That is, since pin 15 is square, secondary lever 3 also rotates counter-clockwise. This causes its other end which is in constant contact with the roller drive 4 (used here to lower the friction of the contact area) to push against that roller drive, thereby lifting the connecting bar 5, plus the support rail 7, and the pitch linear guide 6 in the second (upward) direction orthogonal to the first direction moved by carriage 16. On top of this pitch linear guide 6 slides back and forth, guided in the pitch linear guide 6, a gripper holding bar, which holds the part grippers 13 (FIG. 4). These grippers have the particular configuration required for each part operation. Therefore, this gripper holding bar and the grippers for each side form an interchangeable gripper/bar set for each part, usually two bars for each part to be processed.

This movement results in relation to the stamped parts in the following process: when the transfer reaches the stop forward limit 11 the grippers are in a position below the part in process to pick it up, therefore the bars lifting motion lifts also the parts and in sequence the transfer or pitch movement is activated, moving or transferring all the parts in the process to the next process or die station. The backwards motion sequence is not exactly the opposite, but being driven by the ball screw backwards it lowers the rails and parts in the next station, opens the grippers and the pitch/transfer motion brings all the grippers to the initial or home position.

The entire cycle made by the transfer die set here described follows a continuous and constant operational synchronism, which basically needs only two power driven units to have the desired three axis motion, being one for driven system for the gripper 13 closing and lifting movements, and another driven system for the pitch or transfer (to next process station) movement.

This operational transfer cycle, basically follows the same cycle made by any three axis transfer systems for a stamping process operation, including the respective patents noted above. What is different is the mechanical configuration, including the lever means, where the present system is much simpler to perform the same functions.

The vertical displacement of the lifting guide 6, activated by the connecting bar 5, performs a suitable travel to lift the stamped part in process, as well as its other horizontal displacements.

Usually working in pairs, but it can be in some cases one side only, the transfer part grippers are positioned orthogonal to the transfer parts flow center line, having an equal distance (pitch) between them corresponding to the distance of die stations.

Finally, the transfer die sets are usually, but not always, assembled in common die shoes 14, which usually also receive the sequence of die sets one for each die process station, just as in any traditional or progressive tooling system. This present embodiment shows the drive system using ball screw 8, the ball screw case 12, primary lever 1, etc. Even so, the drive system can be performed by any other known driven type, for example, with the utilization of mechanical cams, pneumatic or hydraulic cylinders that will result in the linear displacement of the primary lever 1 or element 12 of the mentioned system.

Although the foregoing has described and illustrated a preferred form of construction, this should not be understood as limiting the scope of the invention but as merely providing illustrations of the presently preferred embodiments of this invention. Several ramifications are possible, mainly related to the assembly type of the transfer system, to better accommodate the transfer with the press and the tooling. Some examples of ramifications that are possible are:

The transfer die sets can be assembled in: die shoes; or on one or two sub-plates; these sub-plates can be attached to the die shoes or to the press; in this case they must be removable for die set-up; or mounted at the press uprights or columns When the transfer die sets are mounted at press uprights, they must be four separated kits and connected two by two, with one or two interchangeable bars (one for each side).

Still other modifications of the lifting mechanism will become apparent to one of ordinary skill in the art and all such modifications are to be considered as coming within the scope of the following claims.

What is claimed is:

1. Apparatus for use in a transfer system for causing movement in first and second orthogonal directions, comprising:

first movable means movable in said first direction, moving means for moving said first movable means in said first direction for a predetermined distance, second movable means movable in said second direction, and lever means, including first and second levers connected at a fixed relative angle to one another at corresponding respective ends thereof, said lever means having a first end operably connected to said second movable means and a second end constructed and arranged so as to be movable by said moving means, after said first movable means travels said predetermined distance, to rotate said lever means and thereby move said second movable means in said second direction.

2. Apparatus for use in a transfer system for causing movement in first and second orthogonal directions, comprising:

first movable means movable in said first direction, moving means for moving said first movable means in said first direction for a predetermined distance, second movable means movable in said second direction, and primary and secondary levers fixed at one end at an angle, said secondary lever having a second end abutting said second movable means, said moving means being operable after said first movable means travels said predetermined distance to rotate said primary lever which in turn rotates said secondary lever to cause said second end of the secondary lever to move said second movable means in said second direction.

3. Apparatus as in claim 2 wherein said moving means includes a rotatable ball screw which extends in said first direction.

4. Apparatus as in claim 2 wherein said second movable means has, where said secondary lever abuts said second movable means, a free wheeling roller.

5. Apparatus for use in a transfer system for causing movement in first and second orthogonal directions, comprising:

a rotatable ball screw extending in said first direction, a ball screw housing movable along said screw in said first direction upon rotation of said ball screw, movable means movable in said second direction, carrying means for carrying said movable means, and movable in said first direction upon rotation of said screw, stop means for stopping movement of said carrying means after a predetermined movement in said first direction without at the same time stopping continued movement of said ball screw housing, a pivoted primary lever connected at its pivot point to said ball screw housing, and a secondary lever fixedly secured at one end to said primary lever at a point on said primary lever away from said pivot point, said secondary lever being disposed with its other end contacting said movable means, said continued movement of said ball screw housing causing rotation of both said primary and secondary levers and said rotation of said secondary lever causing movement of said movable means in said second direction.

* * * * *